United States Patent [19]

Carrico

[11] Patent Number: 4,895,613

[45] Date of Patent: Jan. 23, 1990

[54] FILM LINEAR STRIPPER

[76] Inventor: Kenneth Carrico, 1201 Gulf Stream Way, Singer Island, Fla. 33404

[21] Appl. No.: 207,455

[22] Filed: Jun. 16, 1988

[51] Int. Cl.[4] ..... B32B 31/18

[52] U.S. Cl. ..... 156/344; 156/64; 156/269; 156/271; 156/378; 156/523; 156/527; 156/584

[58] Field of Search ..... 156/64, 269, 271, 344, 156/510, 523, 527, 378, 584

[56] References Cited

U.S. PATENT DOCUMENTS

| | | | |
|---|---|---|---|
| 4,182,645 | 1/1980 | Hill | 156/584 X |
| 4,214,933 | 7/1980 | Off et al. | 156/344 X |
| 4,425,182 | 1/1984 | Jones et al. | 156/527 X |
| 4,670,085 | 6/1987 | Van der Meer et al. | 156/584 |

*Primary Examiner*—Robert A. Dawson
*Attorney, Agent, or Firm*—Malin, Haley, McHale

[57] ABSTRACT

The subject invention relates to a device for cutting and stripping the backing film from a sheet of MYLAR film. There are two embodiments disclosed. The first embodiment relates to the packaging of MYLAR film in a box with disposable end plates attached to the roll core. A pair of stripping rollers are rotatably attached to the film core to permit rotation of the stripping rollers as the film is pulled from the storage roller. With the backing film inserted between the sripping rollers the backing film is automatically stripped from the MYLAR film as it is pulled from the box. A cutter and measuring mechanism including a horizontal and vertical cutter with automatic retract for the horizontal cutter is also provided. The second embodiment relates to a device used by professional MYLAR installers. The professional unit includes the same cutting and measuring mechanism, however, a further roller mechanism is provided to permit the unused portion of MYLAR with its backing film attached to be rolled thereon, while the portion being used is automatically stripped of its backing film.

15 Claims, 2 Drawing Sheets

FILM LINEAR STRIPPER

BACKGROUND OF THE INVENTION

Due to the relatively recent discovery of MYLAR, new uses are being found for a product of this type. As is well known, MYLAR is a manufactured film product that is being used extensively throughout the country, especially the southern region where the sun is much more intense.

MYLAR is a commercially available product which is sold in rolls of various lengths and widths. Each roll of MYLAR is mounted on a plastic or cardboard spindle. The MYLAR film is currently being applied to the inside of windows found in homes, office buildings, condominiums, autos, vans, buses and the like to reduce solar radiation and also serves to prevent shattering of the glass in the event of breakage. The MYLAR film is provided with a backing which must be removed to expose the adhesive which is applied to the mating side of the MYLAR strip.

Since the installation procedure for installing MYLAR is a time consuming operation and prevailing labor rates are high, any reduction in the amount of time required to complete a particular job produces significant savings in labor costs. Additionally the costs of MYLAR has been increasing and any means whereby the amount of wasted material can be reduced helps to make a bid on a particular job more competitive.

SUMMARY OF THE INVENTION

With the above noted considerations in mind applicant has designed a MYLAR film stripper wherein the film can be pulled from the storage roll to its desired length and through the use of applicant's novel device the backing strip will automatically be stripped for discarding. In addition to stripping the backing film from the strip to be used, applicant's device also provides for the take-up of good MYLAR with its backing strip still attached. This portion is normally wasted and thrown away. However, with applicant's device the excess width of roll can be saved and perhaps used on a window of lesser width.

The subject invention is provided with a first measuring and cutting means for providing a horizontal cut to the film as it leaves the roll. Additionally, one or more cutting blades may be utilized to make a vertical cut on MYLAR at the desired width for that particular job. The subject invention provides a film stripper whereby a single skilled worker can make the most efficient use of his time and simultaneously provide a means for saving the unused portions of MYLAR which would normally have been thrown away as scrap. A further advantage of applicant's device is that the saved portions of MYLAR are stored on a take-up roller which greatly reduces the possibility of creases or fold lines which would be very hard to work out of the film at the time of installation.

OBJECTS OF THE INVENTION

An object of the invention is to provide a MYLAR film stripper which simultaneously strips the backing film as it is pulled from the storage roll.

A further object of the invention is the provision of horizontal measurement and cutting means.

A still further object of the invention is the provision of a take-up roller which stores the unused strip of MYLAR and backing film.

Yet another object is the provision of vertical cutting means which are adjustable to the desired width or widths, i.e. one or more strips.

A further object of the invention is the provision of a device which can accommodate various roll sizes up to five feet in width.

A still further object is the provision of an automatic recoil system for the horizontal cutting means.

These and other objects of the invention will become more apparent hereinafter. The instant invention will now be described with particular reference to the accompanying drawings which form a part of this specification wherein like reference characters designate corresponding parts throughout the several views.

DETAILED DESCRIPTION OF THE DRAWINGS

Figure 1:
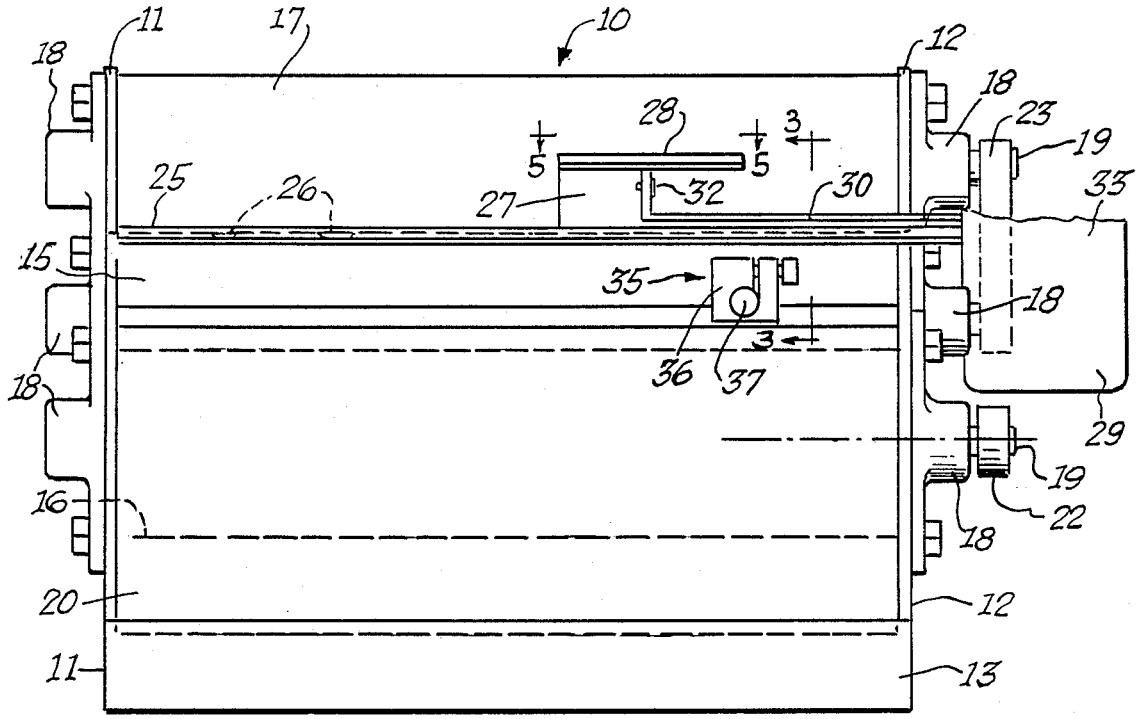
FIG. 1 is a front view of the professional model of film stripper and cutter.

Referring now to FIG. 1 there is shown the first embodiment of the MYLAR film stripper and cutter unit generally indicated by reference numeral 10. Film stripper and cutter unit 10 comprises a pair of end plates 11 and 12 which are preferably made of aluminum to reduce the overall weight of the unit. However, other materials such as a high strength plastic would be suitable. End plates 11 and 12 are spaced approximately sixty-one (61) inches apart to permit the insertion of a five foot roll of MYLAR therebetween with approximately one half inch clearance at each end to permit the roll to turn easily. End plates 11 and 12 are provided with lower front and rear support members, 13 and 14, respectively. Lower support members 13 and 14 are either bolted or welded to end plates 11 and 12 as is upper front support member 15. All three support members cooperating to provide stability to end plates 11 and 12 and unit 10 as a whole.

Positioned between and operably mounted in end plates 11 and 12 are a pair of rollers 16 and 17 with roller 16 supporting the roll of MYLAR film 20 and roller 17 serving as the take-up roller for the MYLAR film to be saved after cutting. Each of rollers 16 and 17 is mounted in bearing units 18 and provided with stub shafts 19 which project through the bearing units 18 mounted in plate 12 and receive pulleys 21. In addition to supporting roller 16 and take-up roller 17 a pair of stripping rollers 24 are provided. However stripping rollers are not readily visible in FIG. 1. A pair of positive drive V-belts 22 and 23 are interconnected with pulleys 21 and serve to drive stripping rollers 24 as well as take-up roller 17 as the MYLAR film is automatically pulled from the MYLAR film roll 20.

Upper front support member 15 serves as the mount for guide 25 which is anchored thereto by a plurality of flush headed screws 26. Guide 25 receives supporting block 27 which serves as the main support means for horizontal cutting means 28. As illustrated, guide 25 extends from left end plate 11 to the right beyond right end plate 12. Securely mounted to the rightmost end of upper front support member 15 is tape measure 29 with its tape 30 reversed so as to be readable from the top. The extreme end of tape 30 is provided with an upstanding tab 31 which is secured to supporting block 27 by a screw 32. Tape measure 29 is provided with the usual release member 33 which, when depressed, retracts tape 30, supporting block 27 and horizontal cutting means 28 to cut the MYLAR film horizontally.

In addition to horizontal cutting means 28 there is shown the vertical cutting means 35. Vertical cutting means 35 comprises a slotted holder 36 which fits over the vertical leg of front support 13 and held thereon by a set screw 37. Shown in dotted lines is a second set screw 38 which secures single edge blade 39 to holder 36. Holder 36 and single edge blade 39 can be positioned at any horizontal location along front support 13 depending upon the desired width of MYLAR to be cut. In addition, a plurality of such blade holders 36 may be positioned at their desired locations along front support 13 thus permitting a plurality of strips to be cut simultaneously from the roll of MYLAR.

Figure 2:
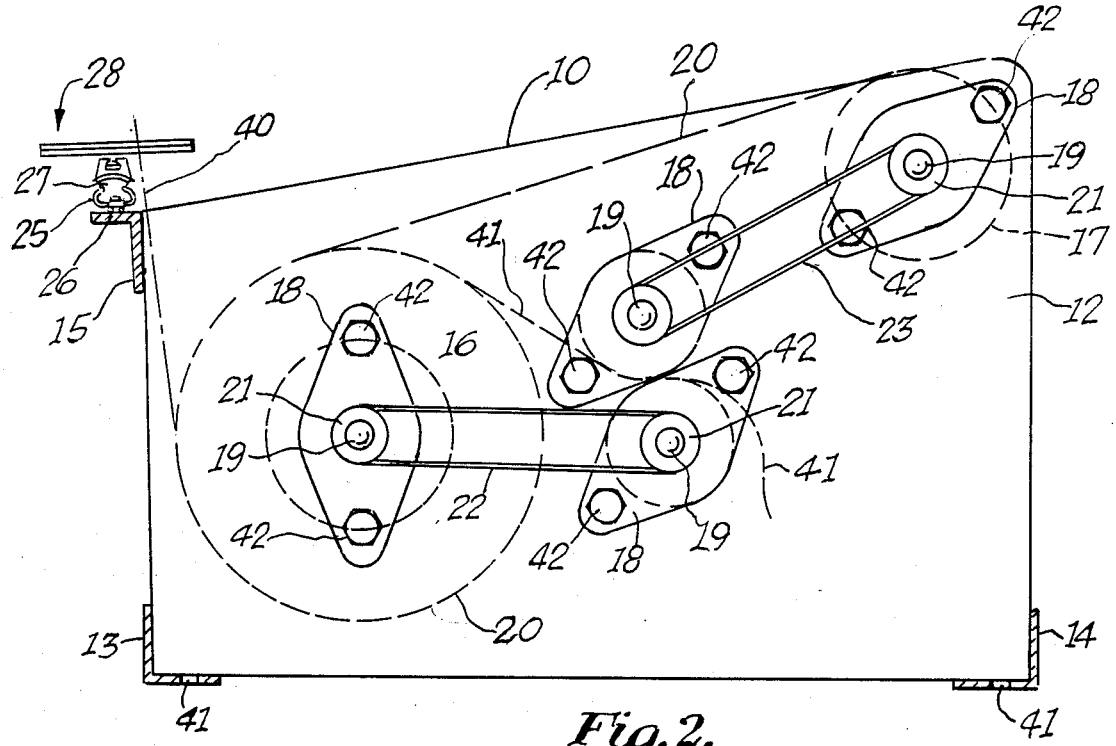
FIG. 2 is a side view of the film stripper and cutter shown in FIG. 1 looking at the right side thereof.

Referring now to FIG. 2, there is illustrated an end view looking at the right end of the stripper/cutter assembly 10. FIG. 2 clearly illustrates, in broken lines, the arrangement of supporting roller 16 on which the roll of MYLAR film 20 is mounted. In FIG. 2, the housing for tape measure 29 has been removed to provide a clearer illustration of guide 25, supporting block 27 and horizontal cutting means 28. As can be seen in FIG. 2, end plates 11 and 12 are higher at the rear end than at their forward end. The purpose of this is to raise take-up roller 17 out of the way and provide the required space for stripping rollers 24. FIG. 2 further provides a clear illustration of the path of the MYLAR film as it leaves roll 20. As indicated at 40, MYLAR film is brought inside of horizontal cutting means 28 with backing film 41 being manually introduced between stripping rollers 24 which are in substantial contact with each other while the piece of MYLAR film and its backing film to be saved are fed onto take-up roller 17. As the MYLAR film 40 is pulled vertically past horizontal cutting means 28 to the desired length, the rotation of supporting roller 16 and shaft 19 with its attached pulley 21 through means of positive drive V-belt 22 drives lower stripping roller 18 which in turn drives upper stripping roller 18. Positive drive V-belt 23 is interconnected with pulley 21 which drives take-up roller 17. After the backing film 41 has fed between stripping rollers 18 and the MYLAR film and backing film started on take-up roller 17 any further pulling upward on the MYLAR film 40 will result in the backing film 41 automatically being stripped and the unused portion of MYLAR being wound on take-up roller 17 for subsequent use. After backing film 41 passes between stripping rollers 18 it merely falls to the floor. As further illustrated in FIG. 2, lower front support 13 and rear support 14 are each provided with threaded apertures 43 at each end thereof. The purpose of threaded apertures 43 is to permit attachment to tripods (not shown) if so desired. Bearing units 8 are also shown as being securely mounted to right end plate 12 by a plurality of bolts 42 which are threaded into right end plate 12. Left end plate 11 is provided with identically placed bearing units 8 to provide roller support at their opposite ends.

Figure 3:
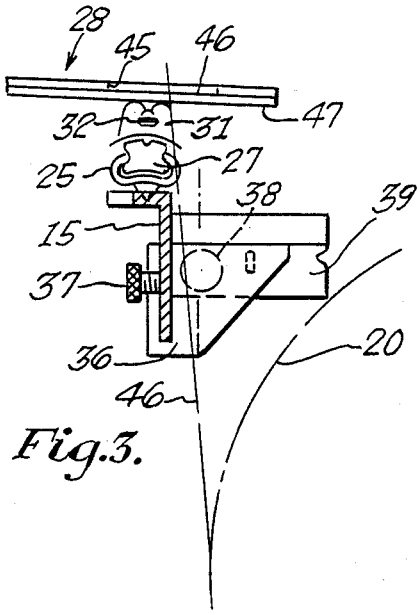
FIG. 3 is a sectional view taken along the line 3—3 in FIG. 1.

Referring now to FIG. 3, there is shown an enlarged view of the structure taken on the line 3—3 of FIG. 1. Single edge blade 39 is shown mounted on slotted holder 36. By loosening set screw 37 slotted holder 36 may be moved axially along upper front support 15. In addition, horizontal cutting means 28 which includes blades 45 and 46 arranged at right angles to each other are clearly illustrated in FIG. 3. The edge of film 40 is fed adjacent to the cutting edges of blades 45 and 46 whereby depression of release member 33 on tape measure 29 retracts the tape 30, tab 31, supporting block 27 and blades 45 and 46 horizontally thus cutting the MYLAR film at its desired length.

Figure 4:
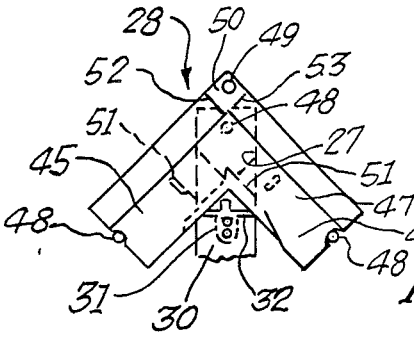
FIG. 4 is an illustration of the horizontal cutting and measuring means with the cover plate removed.
Figure 5:
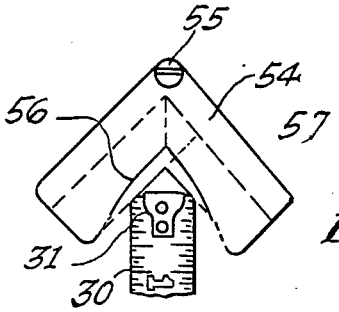
FIG. 5 is a plan view of the horizontal cutting and measuring means taken along the line 5—5 of FIG. 1.

Referring now to FIG. 4, there is shown the horizontal cutting means 28 which includes supporting block 27 which rides in guide 25. Supporting block 27 includes a V-shaped bottom plate 47 which provides planar support for abutting and overlapping blades 45 and 46. Bottom plate 47 has three projecting pins 48 and a threaded aperture 49 in raised portion 50. Intersecting edges of V-shaped bottom plate 47 are cut back at 51 to permit protrusion of the cutting edge of blades 45 and 46. Projecting pins 48 are received in cut-out portions of blades 45 and 46 while raised portion 50 provides abutting edges 52 and 53 for blades 45 and 46, respectively, to insure proper blade alignment. Top plate 54, in FIG. 5, is then placed over overlapping blades 45 and 46 and secured in place by screw 55. As in FIG. 4, top plate 54 is V-shaped and undercut at 56 and 57 to expose blades 45 and 46.

Having described the first embodiment of applicant's invention, it seems to be an appropriate time to discuss the manner of its use.

As indicated earlier, the stripper/cutting assembly 10 is capable of accommodating rolls of MYLAR up to five feet in width assuming that a roll of MYLAR film has been mounted on supporting roller 16, supporting block 27 and horizontal cutting means 28 are pulled to the extreme left, as viewed in FIG. 1. Depending upon whether a single strip or a plurality of strips are to be cut simultaneously, vertical cutting means 35 is positioned at the appropriate width with a reading being taken from tape 30 of tape measure 29. If more than one strip is to be cut simultaneously, additional vertical cutting means 35 must be mounted to upper front support 15 at the appropriate distances. Having set the horizontal cutting means 28 and vertical cutting means 35, the free end of MYLAR film 40 is pulled from the roll 20. Initially, backing film 41 is stripped from the MYLAR film and fed between stripping rollers 18. If there is a portion of the MYLAR film 40 and backing film 41 to be saved, passing the free edge of the film by vertical cutting means 35 will cut the film to the appropriate width permitting the portion of MYLAR film 40 and backing film 41 to be started on take-up roller 17. After the free end of the MYLAR film 40 has been pulled from roll 20 to the desired length, merely depressing release member 33 with a knee or foot automatically retracts tape 30, supporting block 27 and horizontal cutting means 28 and cuts the MYLAR film 40 and backing film 41 simultaneously. As pointed out earlier, rotation of supporting roller 16 and stub shaft 19 is transmitted to lower stripping roller 18 by V-belt 22, since lower stripping roller 18 is in frictional contact with upper stripping roller 18 backing film 41 is pulled therethrough and stripped from the MYLAR film. Rotation of upper stripping roller 18 is transmitted via V-belt 23 to pulley 21 of take-up roller 17 causing rotation thereof and automatic winding of the portion of MYLAR film 40 and attached backing film 41 which is to be saved.

Stripper/cutting assembly 10 is the sturdier embodiment and is intended for use by the professional MYLAR film installers. As illustrated, assembly 10 may be placed on a table or the like or, in the alternative, tripods may be attached to front and rear supports 13 and 14. Use of tripods would provide height adjustment for assembly 10 when used on windows located in high places. As is normal procedure when installing MYLAR film the windows must be prepared in the usual manner before the MYLAR film is applied to the window.

Figure 6:
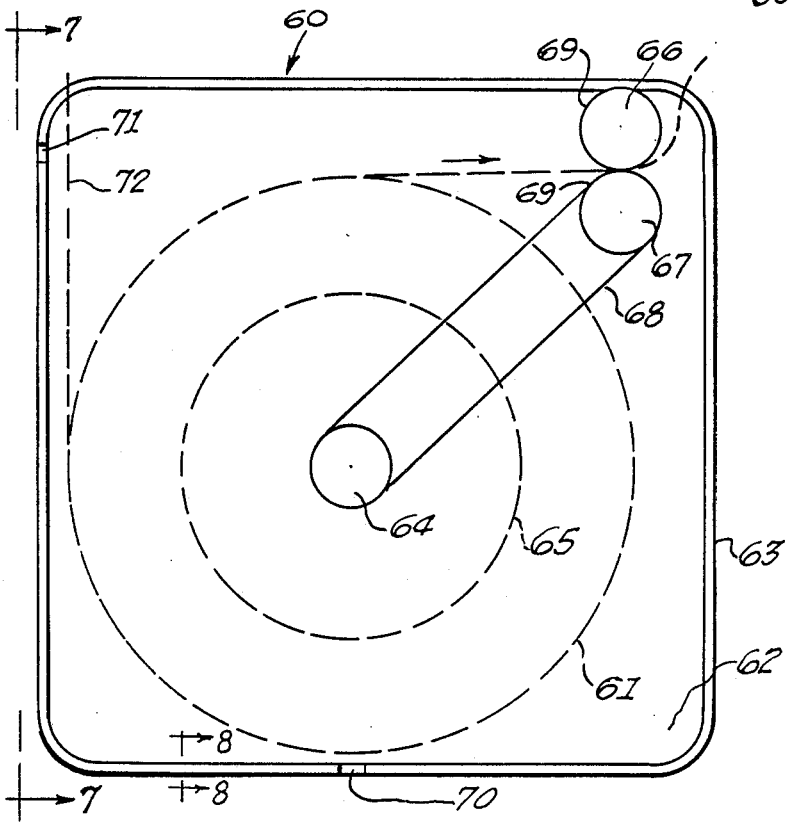
FIG. 6 is a side view of another embodiment of the film stripper unit.

Referring now to FIG. 6, which is a stripper/cutter assembly 60 for the homeowner or do-it-yourselfer. As illustrated in FIG. 6, stripper/cutter assembly 60 is a disposable plastic model wherein the MYLAR roll 61 is preassembled on a pair of end plates 62 which are provided with a peripheral wall 63, thus presenting a recessed end plate 62 as viewed from FIG. 6. Centrally located relative to end plate 62 is support shaft 64 which is provided with a plastic core 65 which is received by the center opening of MYLAR roll 61 and provides support thereto. In addition to support shaft 64 a pair of lesser diameter stripping rollers 66 and 67 also project through and are supported by end plate 62 appropriate sized bores are provided in end plate 62 for this purpose. As illustrated in FIG. 6, support shaft 64 is interconnected with stripping roller 67 with a rubber band 68 which serves as the drive means for stripping roller 67. To provide frictional contact between stripping rollers 66 and 67 a plurality of smaller rubberbands 69 are placed over these rollers. Peripheral wall 63 is provided with a first threaded aperture 70 which could optionally receive a tripod for support. A second threaded aperture 71 is provided in peripheral wall 63 which receives a bolt (not shown) for mounting a front support 15, horizontal cutting means 28 and vertical cutting means 35 as illustrated in FIG. 3. It must be kept in mind that a second end plate 62 is located at the opposite end to similarly support shaft 64 and stripping rollers 66 and 67. As indicted above, the MYLAR roll 61 and end plates 62 will come so assembled in an appropriately sized carton. The user merely has to attach front support 15, horizontal cutting means 28 and vertical cutting means 35 as illustrated in FIG. 3 and the unit will be ready for use. The path of the MYLAR film 72 is illustrated as pulled vertically while the backing film 73 which has been fed between stripping rollers 69 is automatically pulled from the MYLAR film 72. It is to be noted that this embodiment has no provision for take-up of any MYLAR film and backing film to be saved as in FIGS. 1 and 2 embodiment.

Figure 7:
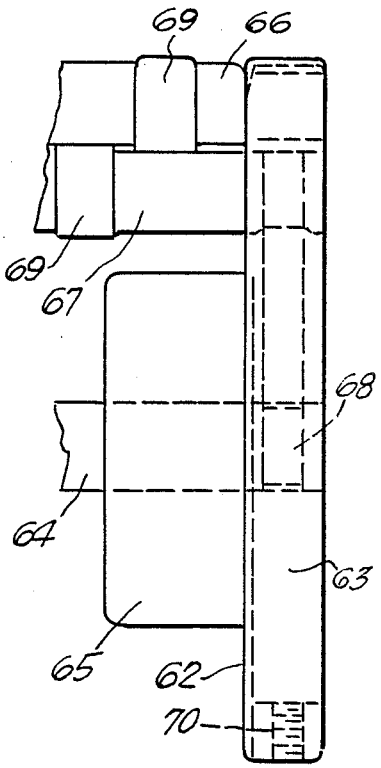
FIG. 7 is a front view of the unit shown in FIG. 6 as indicated by the line 7—7 illustrating only the right end thereof.

Referring now to FIG. 7 there is illustrated a front view of cutter/stripper assembly 60 as seen from line 7—7 of FIG. 6 less the roll of MYLAR film 61. Drive rubber band 68 is shown in dotted lines since it is hidden by peripheral wall 63. Additionally, rubber bands 69 are shown in contact with stripping rollers 66 and 67, as indicated earlier, rubber bands 69 produce the necessary friction whereby roller 67 will drive roller 66 and cooperate to strip backing film 73.

Figure 8:
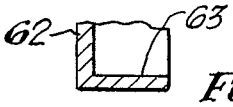
FIG. 8 is a sectional view taken on the line 8—8 of FIG. 6.

FIG. 8 is a sectional view taken through end plate 62 as indicated at 8—8 on FIG. 6. The purpose of this figure is to clearly illustrate the depth of peripheral wall 63 which houses the projecting shafts 64, 66 and 67 and drive band 68.

The embodiment of FIGS. 6–8 is intended for one time use by the do-it-yourselfer and as such, as many of the components as possible are made of plastic to reduce the weight and packaging costs.

While the invention has been described in its preferred embodiments, it is to be understood that the words which have been used are words of description rather than limitation and that changes may be made within the purview of the appended claims without departing from the full scope or spirit of the invention.

Having thus described my invention, I claim:

1. A film and backing stripping, measuring and cutting device comprising in combination a pair of spaced end plates, support means operably interconnecting said end plates; roller means including feeding and stripping rollers for feeding and stripping said film and backing, horizontal measuring and cutting means mounted on said support means, wherein said horizontal measuring means is connected to said horizontal measuring means, vertical cutting means also positioned on said support means and drive means interconnecting said roller means whereby said film is cut vertically and is stripped of its backing material when pulled from said roller means and actuation of said horizontal measuring and cutting means provides a horizontal cut to said film and backing material.

2. The combination as set forth in claim 1 wherein said device is a disposable unit with said end plates, roller means and support means all made of plastic material to reduce the cost and overall weight of said device.

3. The combination as set forth in claim 1 wherein said end plates are made of lightweight, high strength aluminum and said roller means further includes a take-up roller for receiving unused film and backing.

4. The combination as set forth in claim 1 wherein said end plates are provided with threaded apertures for attaching tripods thereto.

5. The combination as set forth in claim 1 wherein said support means includes at least one horizontally extending support; said at least one horizontally extending support further providing support for a horizontally extending guide means which receives a supporting block for said horizontal cutting means.

6. The combination as set forth in claim 5 wherein said at least one horizontally extending support further supports said horizontal measuring means; said horizontal measuring means including a housing and a self-retracting tape measure mounted therein; said tape measure including a tab at its free end which is anchored to said supporting block; said housing provided with a release member whereby depressing said release member automatically retracts said tape measure, supporting block and horizontal cutting means to provide a horizontal cut to said film and backing material.

7. The combination as set forth in claim 6 wherein said at least one horizontally extending support further supports said vertical cutting means.

8. The combination as set forth in claim 7 wherein said vertical cutting means includes a slotted holder which is adjustably mounted on a lower edge of said at least one horizontally extending support and said slotted holder receives a perpendicularly disposed cutting means whereby said film and backing material are cut vertically as said film and backing material are pulled vertically by said perpendicularly disposed cutting means.

9. The combination as set forth in claim 8 wherein said vertical cutting means includes a plurality of said perpendicularly disposed cutting means placed at predetermined locations along said at least one horizontally extending support whereby a plurality of film strips may be cut simultaneously.

10. A device for use with a roll of solar radiation reducing film having a backing film attached thereto wherein said solar radiation reducing film can be cut to a desired measurement and the backing film is simultaneously stripped therefrom; said device comprising: a pair of end plates for receiving drive roller means; a roll of solar radiation reducing film mounted on said drive roller means; horizontal support means attached to and providing support for said pair of end plates; measuring means including horizontal cutting means attached to said horizontal support means; vertical cutting means adjustably positioned on said horizontal support means; stripping means positioned between and supported by said pair of end plates; drive means operably connected to said drive roller and said stripping means whereby pulling said solar radiation reducing film from said roll provides a vertical cut thereto and simultaneously strips said backing film therefrom and actuation of said horizontal cutting means provides a horizontal cut to said solar radiation reducing film and said backing film.

11. A device of the character described in claim 10 wherein said pair of end plates, drive roller means and stripping means are each made of disposable lightweight plastic.

12. A device of the character described in claim 10 wherein said stripping means comprises a pair of rollers mounted on said pair of end plates, each of said pair of rollers having friction means to assist in driving one of said pair of rollers as well as increasing the frictional hold on said backing film when fed between said pair of rollers.

13. A device of the character described in claim 12 wherein said drive means comprises an elongated rubber band which is interconnected with said drive roller and one of said pair of rollers of said stripping means.

14. A device of the character described in claim 10 wherein said measuring means comprises a retractable tape measure which operably is mounted to said horizontal support means and said horizontal cutting means is attached to the free end of said retractable measuring means; said horizontal cutting means includes a pair of cutting blades which are mounted in an overlapping configuration thus presenting a pair of cutting edges forming a Vee whereby retraction of said tape measure automatically provides a horizontal cut to said solar radiation reducing film and said backing film when engaged therewith.

15. A method of simultaneously cutting and stripping the backing film from solar radiation reducing film, said method comprising the following steps:

(a) providing a roller support means for a roll of solar radiation reducing film;

(b) providing horizontal measuring and cutting means on said roller support means wherein said horizontal measuring means is connected to said horizontal cutting means;

(c) providing adjustable vertical cutting means on said roller support means;

(d) providing a pair of stripping rollers for stripping the backing film from said solar radiation reducing film;

(e) operably connecting said roller support means and said pair of stripping rollers;

(f) manually feeding said backing film between said stripping rollers; whereby further pulling of said solar radiation reducing film from said roll automatically strips said backing film therefrom and actuation of said horizontal measuring and cutting means provides a horizontal cut to said solar radiation reducing film and said backing film.

* * * * *

UNITED STATES PATENT AND TRADEMARK OFFICE

CERTIFICATE OF CORRECTION

PATENT NO. : 4,895,613

DATED : January 23, 1990

INVENTOR(S) : Kenneth Carrico

It is certified that error appears in the above-identified patent and that said Letters Patent is hereby corrected as shown below:

On the cover page, in the title, delete "LINEAR" and replace therefore -- LINER --.
and (col. 1, line 2)

Signed and Sealed this

First Day of January, 1991

*Attest:*

HARRY F. MANBECK, JR.

*Attesting Officer*

*Commissioner of Patents and Trademarks*